US008270868B2

(12) United States Patent
Sugiyama

(10) Patent No.: US 8,270,868 B2
(45) Date of Patent: Sep. 18, 2012

(54) IMAGE FORMING APPARATUS AND CLEANING MECHANISM

(75) Inventor: Yoshihiko Sugiyama, Saitama (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 154 days.

(21) Appl. No.: 12/833,792

(22) Filed: Jul. 9, 2010

(65) Prior Publication Data

US 2011/0013927 A1 Jan. 20, 2011

Related U.S. Application Data

(60) Provisional application No. 61/226,606, filed on Jul. 17, 2009, provisional application No. 61/226,614, filed on Jul. 17, 2009.

(51) Int. Cl.
*G03G 15/16* (2006.01)
*G03G 21/00* (2006.01)

(52) U.S. Cl. ..... 399/99; 399/101; 399/349

(58) Field of Classification Search ..... 399/101, 399/349, 343, 99, 98, 353; 15/256.5, 256.51, 15/256.52

See application file for complete search history.

(56) References Cited

U.S. PATENT DOCUMENTS

| | | | | |
|---|---|---|---|---|
| 5,655,204 | A * | 8/1997 | Siegel | 399/349 |
| 5,715,512 | A * | 2/1998 | Kumagai | 399/349 |
| 2005/0254852 | A1* | 11/2005 | Kitagawa | 399/101 |
| 2009/0035038 | A1 | 2/2009 | Sugimoto et al. | |
| 2009/0311004 | A1* | 12/2009 | Naruse et al. | 399/101 |

FOREIGN PATENT DOCUMENTS

| | | | |
|---|---|---|---|
| JP | 11-038776 | A | 2/1999 |
| JP | 11-038777 | A | 2/1999 |
| JP | 2002-182490 | A | 6/2002 |
| JP | 2005-157122 | | 6/2005 |
| JP | 2005250047 | A | 9/2005 |
| JP | 2006215072 | A | 8/2006 |
| JP | 2007140317 | A | 6/2007 |
| JP | 2007310312 | A | 11/2007 |

* cited by examiner

*Primary Examiner* — Sophia S Chen
(74) *Attorney, Agent, or Firm* — Patterson & Sheridan, LLP

(57) ABSTRACT

According to one embodiment, a method for cleaning including, scraping off, agitating, or capturing, in non-contact with a belt surface, a visualizing material present on the belt surface and fiber or powder different from the visualizing material, coming into contact with the belt surface and scraping off, agitating, or capturing the visualizing material present on the belt surface and the fiber or the powder different from the visualizing material, and being located in contact with the belt surface at predetermined pressure and scraping off the visualizing material present on the belt surface and the fiber or powder different from the visualizing material.

16 Claims, 8 Drawing Sheets

IMAGE FORMING APPARATUS AND CLEANING MECHANISM

CROSS-REFERENCE TO RELATED APPLICATIONS

This application is based upon and claims the benefit of priority from: U.S. Provisional Applications No. 61/226,606 and No. 61/226,614 both filed on Jul. 17, 2009, the entire contents of each of which are incorporated herein reference.

FILED

Embodiments described herein relates generally to an image forming apparatus and a cleaning mechanism.

BACKGROUND

A toner (a visualizing agent) moves to a sheet medium on the basis of image information and is integrated with the sheet medium. The sheet medium (integrated with the toner) is a hard copy.

The toner includes an "unnecessary toner" that moves to a non-image area, which does not include the image information and is not required to be moved to the sheet medium, and various sections different from the sheet medium.

The "unnecessary toner" causes stains of the sheet medium and an image failure of the hard copy.

DETAILED DESCRIPTION

In general, according to one embodiment, a method for cleaning including, scraping off, agitating, or capturing, in non-contact with a belt surface, a visualizing material present on the belt surface and fiber or powder different from the visualizing material, coming into contact with the belt surface and scraping off, agitating, or capturing the visualizing material present on the belt surface and the fiber or the powder different from the visualizing material, and being located in contact with the belt surface at predetermined pressure and scraping off the visualizing material present on the belt surface and the fiber or powder different from the visualizing material.

Embodiments will now be described hereinafter in detail with reference to the accompanying drawings.

An example of an embodiment is explained in detail below with reference to the accompanying drawings.

Figure 1:
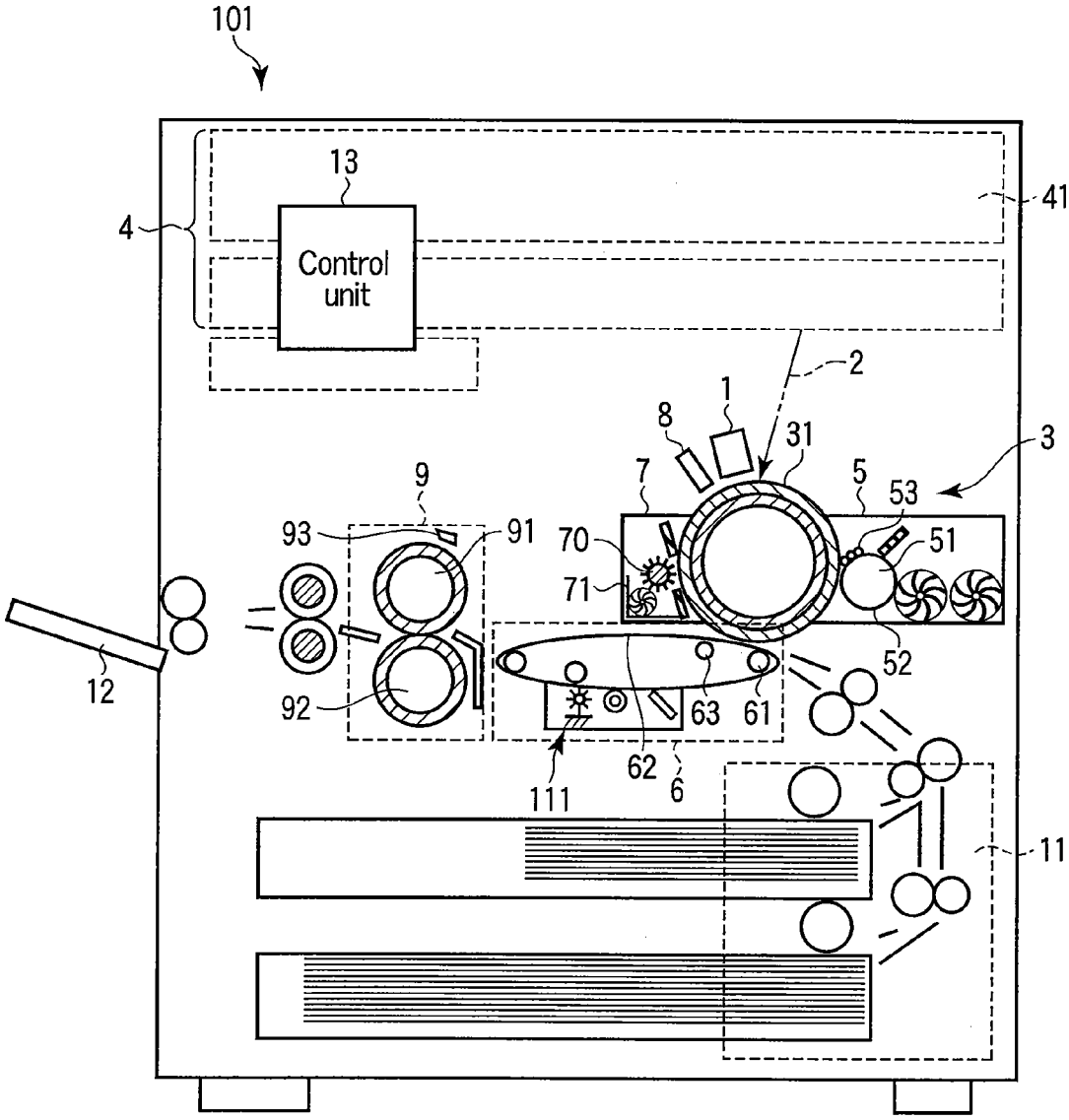
FIG. 1 is an exemplary diagram showing an example of an MFP (Multi-Functional Peripheral) according to an embodiment.

An image forming apparatus (MFP: Multi-Functional Peripheral) 101 shown in FIG. 1 includes at least a charging unit 1, a writing (exposing) unit 2, an image forming (latent image forming, developing, transferring, and cleaning) unit 3, a document reading unit 4, a developing unit 5, a transfer unit (a peeling unit) 6, a cleaning unit 7, a charge removing unit 8, and a fixing unit 9.

The charging unit 1 gives charges having predetermined polarity (in this example, "– (minus)") to a photoconductive layer on the surface of an image bearing member, for example, a cylindrical drum 31 included in the image forming unit 3 explained below. The image bearing member is not limited to the cylindrical drum and may be an endless belt or a cylindrical drum member located on the inner side of the endless belt.

The writing (exposing) unit 2 irradiates exposure light, for example, a laser beam, light intensity of which changes according to image information as a target of image formation, on the photoconductive layer on the surface of the cylindrical drum (hereinafter referred to as photoconductive drum) 31 charged by the charging unit 1 and changes the potential of the photoconductive layer. A latent image is formed in a section where the potential is changed. The image information is provided by the document reading unit 4 explained below or a not-shown external apparatus such as a PC (Personal Computer) or a facsimile. The photoconductive drum 31 has an external diameter of, for example, 100 mm and includes a photoconductive layer 33 on the surface of a metal substrate (hollow aluminum) 32 as indicated by an example shown in FIG. 3. The photoconductive layer 33 includes, for example, an organic photoconductive member (OPC). The metal substrate 32 is electrically grounded (connected) to a housing unit of an image forming apparatus main body as explained below with reference to FIG. 2.

The image forming (latent image forming, developing, transferring, and cleaning) unit 3 conveys a toner image obtained by developing (visualizing) the latent image with toner (a visualizing agent) provided by the developing device 5 to the transfer unit 6, the cleaning unit 7, and the charge removing unit 8 according to the rotation of the image forming unit 3. The photoconductive drum 31 rotates, for example, clockwise (in a CW (clockwise) direction) at predetermined speed.

The document reading unit 4 includes a document reading device 41. The document reading device 41 includes, for example, a CCD sensor with 600 dpi (dots per inch)/7500 pixels (a total number of pixels in a longitudinal direction thereof) and converts image information as a reflected light signal of irradiated light into an electric signal.

The developing unit 5 includes a magnet roller 51 and a developing sleeve 52 that is located on the outer circumference of the magnet roller 51 and rotates on the outer circumference. The magnet roller 51 selectively provides toner 53, which moves on the surface of the developing sleeve 52 according to the rotation of the developing sleeve 52, to the latent image on the surface of the photoconductive drum 31 while magnetically attracting the toner 53. A space between the developing sleeve 52 and the photoconductive drum 31 is managed by a guide roller 54 set in contact with the surface of the photoconductive drum 31. The developing sleeve 52 is formed of a nonmagnetic material such as stainless steel or aluminum.

The transfer unit (the peeling unit) 6 moves, with an electric field provided by a transfer roller 61, the toner image onto a sheet conveyed by a sheet conveying belt 62 (toners forming the toner image subjected to the electric field provided by the transfer roller 61 move to the sheet). A peeling unit 63 separates the toner (the toner image) and the sheet from the surface of the photoconductive drum 31.

In the cleaning unit 7, a waste toner and foreign matter storing unit 71 stores a transfer residual toner (a waste toner), fiber pieces of a sheet, a surface coating agent, or the like scraped off by a removing mechanism 70 such as a brush member (or a brush roller having a cylindrical brush) or a foreign matter conveyed together with the sheet.

The charge removing unit 8 resets the potential of the photoconductive layer on the surface of the image bearing member 31 to an initial state before the charging by the charging unit 1 (removes residual charges on the photoconductive member). The charge removing unit 8 includes an LED array in which LED elements configured to output red light having wavelength longer than, for example, 770 nm are arranged in an axis direction of the drum 31.

When the sheet that bears the toner image (the toner) passes between a fixing roller 91 configured to come into contact with the toner and a pressing roller 92 configured to apply pressure to the fixing roller 91, the fixing unit 9 provides pressure and heat and fixes the toner (the toner image) on the sheet. The fixing roller 91 is a cylinder formed of, for example, aluminum and, although not shown in the figure, includes a heater (a heating mechanism) therein. The heating mechanism may be prepared along the outer circumference of the roller 91. The heat provided to the sheet and the toner (the temperature of the fixing roller 91) is detected by a temperature sensor 93. An output of a heating device is controlled by a control unit 13 not explained in detail, whereby the heat is set within a fixed range. The temperature of the fixing roller 91 is different depending on a characteristic of toner. Although not shown in the figure, the pressing roller 92 applies predetermined pressure to the fixing roller 91 with, for example, a spring and a roller supporting mechanism configured to direct the pressure from the spring to the fixing roller 91.

Figure 2:
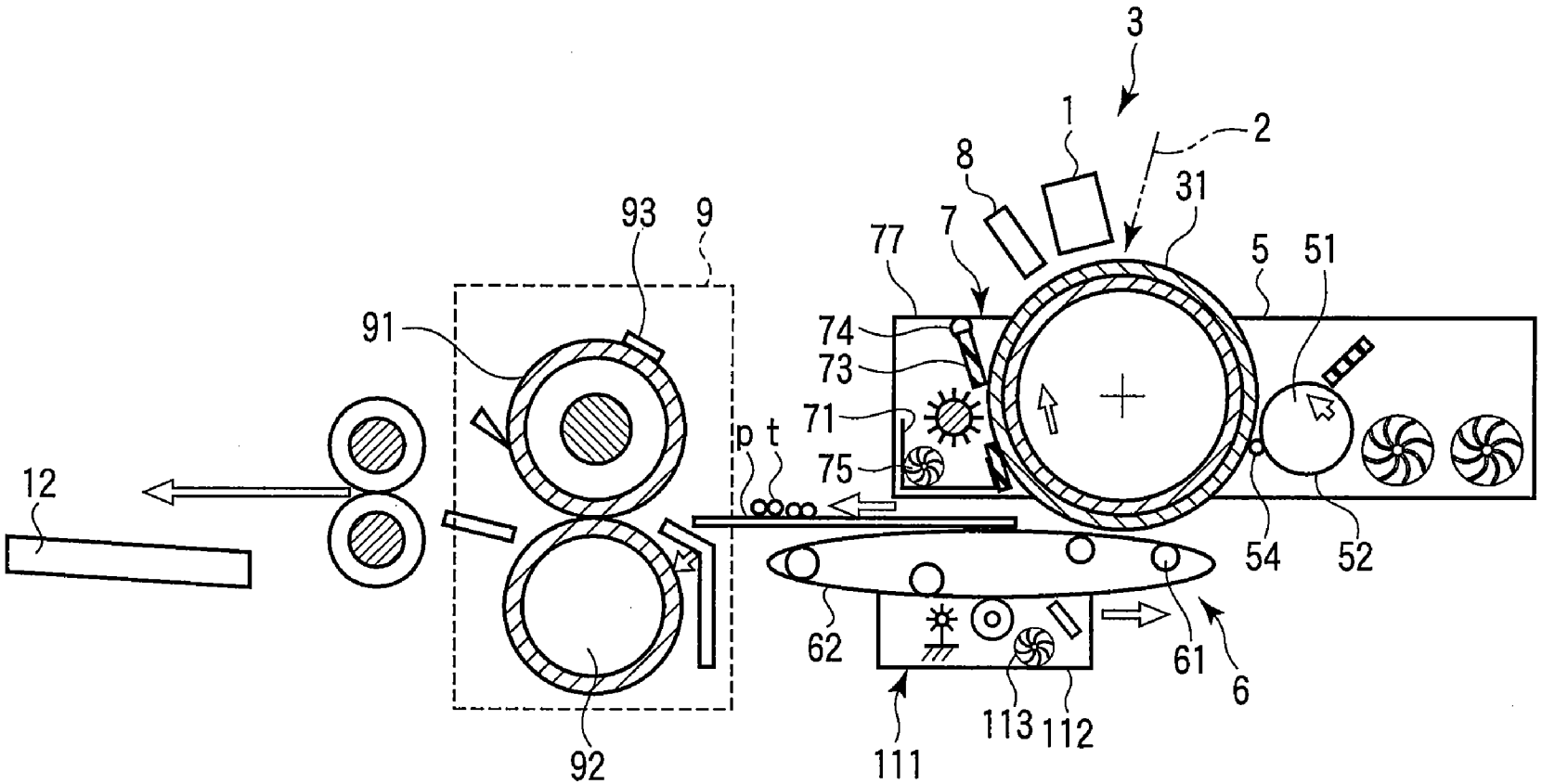
FIG. 2 is an exemplary diagram showing an example of a state of an image forming unit (a component used for processes of development, cleaning, and transfer) included in the image forming apparatus shown in FIG. 1, according to an embodiment.

As shown in FIG. 2, the photoconductive drum 31 is located rotatably with respect to a cleaner case 77 by a bearing and a drum shaft not shown in the figure.

A cleaning blade 73 is fixed to a not-shown base plate (a supporting member). The base plate is fixed to a fulcrum 74 of the cleaner case 77. Consequently, the tip of the blade 73 is pressed against the surface of the drum 31 by a not-shown pressing member such as a spring in a direction counter to a direction in which the photoconductive drum 31 rotates.

The photoconductive drum 31 is located in a predetermined position in the cleaner case 77 such that the cleaning blade 73 can come into contact with the surface of the photoconductive drum 31.

The photoconductive drum 31, the charging unit 1, the charge removing unit 8, and the cleaning unit 7 are incorporated in the cleaner case 77 and are substantially integral with one another. In the cleaner case 77, an auger 75 configured to convey a waste toner and a not-shown discharge unit cover are further prepared. The not-shown discharge unit of the cleaner case 77 is connected to a not-shown waste toner storing unit.

On the opposite side of the side set in contact with the photoconductive drum 31 (an area where it can be expected that the unnecessary toner r and the foreign matters f free-fall with the center of gravity g) on the belt surface of the sheet conveying belt 62, a belt cleaner (a foreign-matter removing mechanism) 111 configured to remove the toner and the foreign matters f are attached because the unnecessary toner r adhering to the sheet conveying belt 62, dust entering the apparatus via a sheet, fiber of the sheet, and the foreign matters f formed by the dust, fiber, and the like integrated with the toner r adhere to the sheet conveying belt 62 because of static electricity.

The belt cleaner 111 includes, in the area where it can be expected that the toner r and the foreign matters f free-fall with the center of gravity, a belt cleaner case 112 configured to store the toner r and the foreign matters f separating and free-falling from the sheet conveying belt 62. The belt cleaner case 112 includes an auger 113 configured to carry, to a predetermined position, the toner r and the foreign matters f separating and free-falling from the sheet conveying belt 62. The auger 113 moves the toner r and the foreign matters f stored by the belt cleaner case 112 to the predetermined position.

As explained in detail later, the belt cleaner 111 removes the unnecessary toner r and the foreign matters f by, for example, capturing (and scraping off) the toner r and the foreign matters f using a brush member, scraping off the toner r and the foreign matters f using a scraper (a blade member), or combining the brush member and the scraper. In addition to capturing and scraping off the toner r and the foreign matters f, it is also possible to absorb the toner r and the foreign matters f using static electricity.

As explained above, as the main configuration, the image forming unit 3 includes the photoconductive drum 31, the cleaning unit 7, the charging unit 1, and the charge removing unit 8 and is collectively detachably attachable to the image forming apparatus main body. This makes it easy to mechanically and electrically connect the image forming unit 3 to the image forming apparatus main body. Specifically, the photoconductive drum 31 can rotate with driving force of a not-shown driving unit on the image forming apparatus main body side. The charging unit 1, the charge removing unit 8, the cleaning unit 7, the transfer unit 6, and the like are electrically grounded (connected) to the housing unit of the image forming apparatus main body.

The image forming apparatus 101 further includes a paper feeding unit 11 configured to feed a sheet to the transfer unit 6 of the image forming unit 3 and a paper discharge unit 12 configured to receive a sheet p on which a toner image t is fixed by the fixing unit 9. The image forming apparatus 101 forms a toner image t corresponding to image information provided by the document reading device 41 of the document reading unit 4 or a not-shown external apparatus such as a PC (Personal Computer) or a facsimile.

Specifically, when image formation is instructed from an operation unit or an external apparatus not shown in the figure, process control by the image forming unit 3 and fixing temperature control by the fixing unit 9 are started according to the control by the control unit 13. A copy output or a printout (a print output) is output by, for example, latent image formation, development, transfer, and cleaning in the image forming unit 3, movement of the toner image to the sheet from the paper feeding unit 11 by the transfer and peeling unit 6, and sheet conveyance control according to image information input by the document reading device 41 or the not-shown external apparatus.

Figure 3:
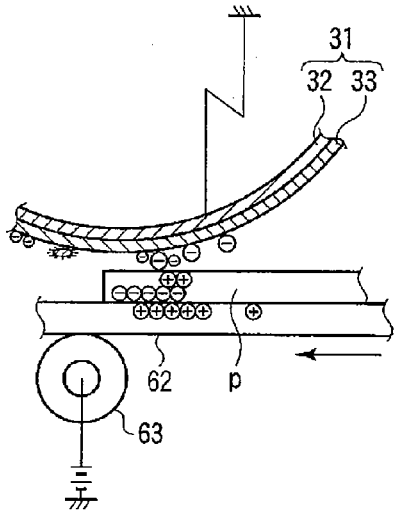
FIG. 3 is an exemplary diagram showing an example of the operation of a transfer device for moving a toner image born on a photoconductive drum shown in FIG. 2 to a sheet material and a characteristic of the transfer device according to an embodiment.

FIG. 3 is a diagram of the operation of a transfer device for moving a toner image born on the photoconductive drum to a sheet material and a characteristic of the transfer device.

Charges from the transfer roller 61 (see FIG. 2), to which voltage having polarity opposite to that of toner is applied, flow to the sheet conveying belt 62 and then flows to a sheet and the photoconductive drum 31. Consequently, a toner image (a visible image) formed on the surface of the photoconductive drum 31 is transferred onto the charged sheet.

The sheet is electrostatically attracted to the surface of the photoconductive drum 31 while bearing the toner image. Therefore, polarization charge (in this example, "– (minus)") is generated on the lower surface of the sheet by the peeling unit 63. The sheet is attracted to the sheet conveying belt 62 by electrostatic attraction acting between the peeling unit 63 and the sheet conveying belt 62 and separated from the photoconductive drum 31.

FIGS. 4A, 4B, 5A, 5B, 6 to 8, 9A, 9B, 10, and 11 are diagrams showing examples of operation and a device for removing an unnecessary toner and foreign matters remaining on a sheet conveying belt as a result of the operation of the transfer device shown in FIG. 2. A belt surface located on the opposite side of the side set in contact with the photoconductive drum 31 on the belt surface of the sheet conveying belt and the vicinity of the belt surface are partially extracted and shown in the figures.

Figure 4A:
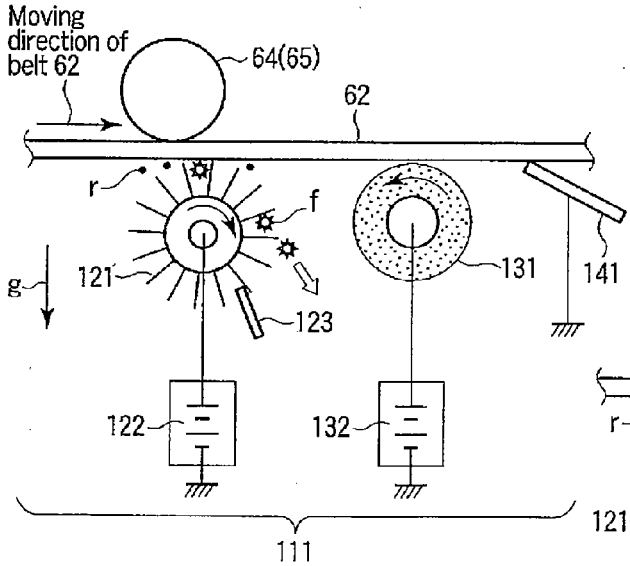
FIG. 4A is an exemplary diagram showing an example of operation and a device for removing an unnecessary toner and foreign matters remaining on a sheet conveying belt as a result of the operation of the transfer device shown in FIG. 2 according to an embodiment.
Figure 4B:
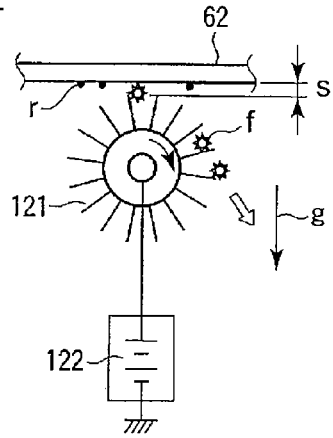
FIG. 4B is an exemplary diagram showing an example of characteristics of the operation and the device for removing the unnecessary toner and the foreign matters shown in FIG. 4A according to an embodiment.

FIGS. 4A and 4B are diagrams showing the basic configuration and array of components of the foreign-matter removing mechanism (the belt cleaner).

As shown in FIG. 4A, the belt cleaner (the foreign-matter removing unit) 111 includes, from an upstream side in a direction in which the belt surface of the sheet conveying belt 62 moves, first and second removing mechanisms 121 and 131 and a scraper (a blade/a third removing mechanism) 141.

The first removing mechanism 121 is configured by arraying fiber members having fixed length on a rotating shaft at predetermined density. The first removing mechanism 121 includes a brush roller configured to rotate such that a moving direction of the outer circumference thereof in a position set in contact with the belt surface is the same as a moving direction of the sheet conveying belt 62. The fiber members are obtained by using, for example, a stainless steel material as a cored bar (a rotating shaft) and fixing a brush including pile conducive acrylic fiber (e.g., AS-7/10D manufactured by Toray Industries, Inc.) to a cored bar section in a spiral shape by bonding, hot melting, or the like in, for example, a right winding direction. Row fabric of the brush has width of, for example, 20 mm to 30 mm. An interval for winding the brush around the cored bar section in the spiral shape is desirably 2 mm to 3 mm. The density of the fiber members is low compared with the density of fiber members used in the second removing mechanism 131, details of which are explained later.

The brush roller (the first removing mechanism) 121 has voltage provided by a power supply 122 having polarity (Plus) opposite to the polarity of the unnecessary toner and the foreign matters. If the brush roller (the first removing mechanism) 121 is grounded without being connected the power supply 122, it can also be expected that an inverted toner i generated at a predetermined probability (the toner having charging polarity inverted to plus because the toner is integrated with the foreign matters or rubs against the sheet material or a surface coating agent on the belt surface of the sheet conveying belt 62) is captured.

As shown in FIG. 4B, the brush roller 121 has a space indicated by "S" between the brush roller 121 and the belt surface of the sheet conveying belt 62. As explained later, by defining an S value larger than 0 mm (sets the brush roller 121 in non-contact with the sheet conveying belt 62), the space indicated by "S" can prevent the belt surface of the sheet conveying belt 62 from being scratched.

A brush cleaner 123 configured to remove, from the brush roller 121, the unnecessary toner and the foreign matters adhering thereto is attached to the brush roller 121. The brush cleaner 123 includes a structure fixed in a predetermined position such as a plate or a projection that induces, when a portion near the tip of the brush of the brush roller 121 hits against the brush cleaner 123, bending or the bending and reaction of the bending at the tip of the brush 121. The brush cleaner 123 is fixed a predetermined distance close to the shaft side of the brush roller 121 compared with the outer diameter of the brush roller 121.

The second removing mechanism 131 is obtained by arraying fiber members having fixed length on a rotating shaft at predetermined density. The second removing mechanism 131 includes a brush roller configured to rotate such that a moving direction of the outer circumference thereof in a position set in contact with the belt surface is against a moving direction of the sheet conveying belt 62. The fiber members are obtained by using, for example, a stainless steel material as a cored bar (a rotating shaft) and densely fixing the brush used in the brush roller 121 in a spiral shape to a cored bar section.

The brush roller (the second removing mechanism) 131 has voltage provided by a power supply 132 having polarity (plus) opposite to the polarity of the unnecessary toner and the foreign matters. If the brush roller (the second removing mechanism) 131 is grounded without being connected the power supply 132, it can also be expected that an inverted toner generated at a predetermined probability (the toner having charging polarity inverted to plus because the toner is integrated with the foreign matters or rubs against the sheet material or a surface coating agent on the belt surface of the sheet conveying belt 62) is captured.

Counter rollers 64 and 65 (or one of the counter rollers 64 and 65) configured to suppress the sheet conveying belt 62 from bending are located, across the sheet conveying belt 62, in a position where the counter rollers 64 and 65 respectively receive pressure from the brush roller 121 and the brush roller 131 or receive pressure from at least one of the brush rollers 121 and 131.

The blade (the scraper) 141 includes urethane rubber having predetermined thickness and hardness molded in a tabular shape or a belt shape. The blade (the scraper) 141 comes into contact with the sheet conveying belt 62 at predetermined pressure. For example, the blade (the scraper) 141 is desirably solid.

When the blade (the scraper) 141 comes into contact with the sheet conveying belt 62, the sheet conveying belt 62 bends in a direction in which the pressure from the blade 141 falls. Therefore, in a state in which the sheet conveying belt 62 is not set, the blade 141 is located such that the tip of the blade 141 is located on the inner side by about 10 mm with respect to an imaginary belt surface in a state in which the sheet conveying belt 62 is arranged. The tip of the blade 141 is desirably located on the inner side by about at least 3 mm with respect to the imaginary belt surface in the state in which the sheet conveying belt 62 is arranged.

As explained later with reference to FIGS. 13A and 13B, in the foreign-matter removing unit configured to remove the unnecessary toner and the foreign matters, each of the first removing mechanism (the non-contact brush roller) 121, the second removing mechanism (the contact brush roller) 131, and the third removing mechanism (the blade (the scraper)) 141 desirably has at least two removing levels in the front to rear direction of the MFP 101, i.e., a direction orthogonal to a direction in which the sheet conveying belt 62 moves while conveying the sheet material.

In Table 1 and Table 2, results of visual evaluation of output images output under conditions shown in Table 1 concerning presence or absence of the first removing mechanism, which is a characteristic of the belt cleaner (the foreign-matter removing mechanism) shown in FIGS. 4A and 4B, are shown.

TABLE 1

| Example | |
|---|---|
| Experiment condition | The image forming apparatus in which the urethane cleaning blade was set in contact with the two-component developer and the drum-like photoconductive member (see FIG. 1) |
| Drum-like photoconductive member | The organic photoconductive member (OPC) formed by processing of different four layers on an aluminum element pipe, external diameter 100 mm (concerning a rotating direction, see FIG. 1) |
| Foreign-matter removing unit arrangement | First removing mechanism: brush roller (rotating member)/brush (non-rotating member)<br>Second removing mechanism: brush roller (rotating member)/brush (non-rotating member)<br>Third removing mechanism: blade (scraper)<br>In order of first, second, and third along the moving direction of the belt surface of the sheet conveying belt<br>An attaching distance between the sheet conveying belt and the first foreign-matter removing unit was C (0 to 5 mm).<br>(See FIGS. 4B, 5A and 6) |
| Characteristic of the brush material of the brush roller | Brush raw fabric was conductive acrylic fiber, pile density 50,000/inch$^2$<br>Brush resistance was $10^4$ to $10^{10}$ Ω under 20° C./60% RH environment |
| Applied voltage | The foreign-matter removing unit was set to 400 V or ground |
| Recording material | Two types, recording material A and recording material B |
| Checking method | 1) As a test of cleanability, an original document is continuously 5,000 sheets print-output at a printing ratio of 50% by an actual machine and a black streak in an image due to a cleaning failure is visually checked.<br>2) Transfer efficiency was forcibly set to a condition of about 70%, a residual toner amount on the sheet conveying belt was set rather larger (not transferred), and a sheet was sent to a cleaning point.<br>3) Presence or absence of the foreign-matter removing unit and an effect by applied voltage were checked. |

TABLE 2

| Presence or absence of the first foreign-matter removing unit | | Recording material A Applied voltage | | Recording material B Applied voltage | | What is found |
|---|---|---|---|---|---|---|
| | | 0 V | 400 V | 0 V | 400 V | |
| First foreign-matter removing unit is absence (no application) | | B | B | C | C | There is a difference depending on recording material |
| First foreign-matter removing unit is present | C = 0 mm | A | A | A | A | |
| | C = 1 mm | A | A | A | A | |
| | C = 2 mm | A | A | A | A | |

TABLE 2-continued

| Presence or absence of the first foreign-matter removing unit | Recording material A Applied voltage 0 V | Recording material A Applied voltage 400 V | Recording material B Applied voltage 0 V | Recording material B Applied voltage 400 V | What is found |
|---|---|---|---|---|---|
| C = 3 mm | B | A | B | A | |
| C = 4 mm | B | B | B | A | |
| C = 5 mm | B | B | B | B | Fine fiber of recording paper slipped through |

Notice: "A" indicates "excellence": "B" indicates "as usual"; and "C" indicates "not excellence."

Figure 5A:
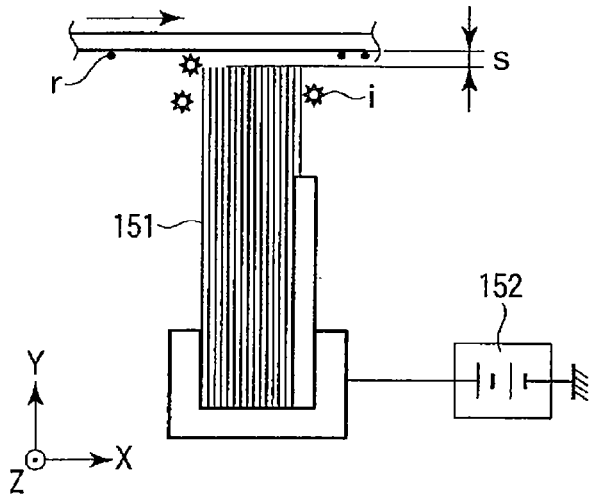
FIG. 5A is an exemplary diagram showing an example of operation and a device for removing an unnecessary toner and foreign matters remaining on a sheet conveying belt as a result of the operation of the transfer device shown in FIG. 2 according to an embodiment.
Figure 5B:
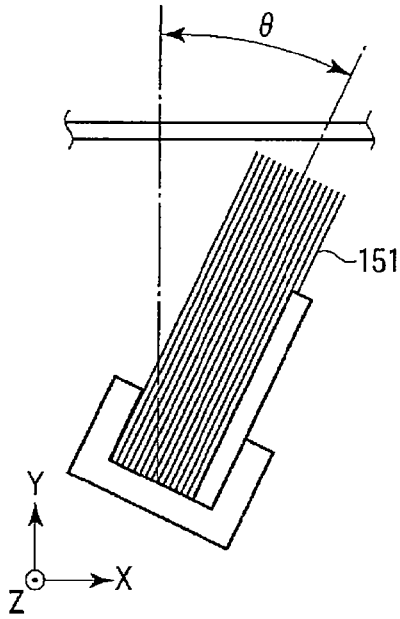
FIG. 5B is an exemplary diagram showing an example of characteristics of the operation and the device for removing the unnecessary toner and the foreign matters shown in FIG. 5A according to an embodiment.
Figure 6:
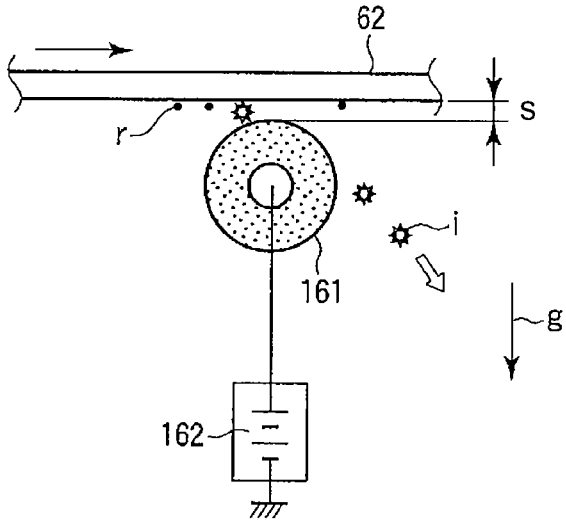
FIG. 6 is an exemplary diagram showing an example of operation and a device for removing an unnecessary toner and foreign matters remaining on a sheet conveying belt as a result of the operation of the transfer device shown in FIG. 2 according to an embodiment.

FIGS. 5A and 5B and FIG. 6 are diagrams showing another embodiment of the first removing mechanism that can be used in the belt cleaner (the foreign-matter removing mechanism) shown in FIGS. 4A and 4B.

FIGS. 5A and 5B are diagrams showing an example in which a substantially fixed brush is used as the first removing mechanism.

As explained later with reference to FIG. 12, a brush 151 shown in FIGS. 5A and 5B includes fiber containing, for example, rayon as a material, the resistance (the specific resistance) of which is set in a predetermined range. The brush 151 has voltage provided by a power supply 152 having polarity (plus) opposite to the polarity of the unnecessary toner and the foreign matters.

The brush 151 has, like the brush 121 explained above, a space indicated by "S" between the brush 151 and the belt surface of the sheet conveying belt 62.

Since the brush 151 does not rotate, it is desirable to thrust the brush 151 in, for example, the longitudinal direction of the photoconductive drum 31, i.e., the front to rear direction of the MFP using a not-shown driving mechanism (e.g., a cam mechanism) and change a position where a specific portion of the brush 151 is opposed to a specific portion of the belt surface of the sheet conveying belt 62. The thrusting assumes a function similar to a function obtained by bringing the brush cleaner 123 into contact with the brush roller 121 shown in FIG. 4A. In other words, vibration during reversal of a swinging and moving direction of the brush 151 by the thrusting is useful for separating the toner and the foreign matters captured by the brush 151 from the brush 151. The thrusting improves an ability for capturing the toner and the foreign matters from the sheet conveying belt 62.

It is desirable that the brush 151 is located in non-parallel to a "Y" direction orthogonal to the longitudinal direction of the photoconductive drum 31, i.e., the front to rear direction of the MFP and the direction in which the belt surface of the sheet conveying belt 62 moves, i.e., a direction orthogonal to the belt surface. It is desirable that, as shown in FIG. 5B, a direction in which the brush 151 tilts with respect to the direction orthogonal to the belt surface is the direction in which the belt surface of the sheet conveying belt 62 moves. An amount of the tilt (an angle θ) is desirably, for example, 20° to 30°.

FIG. 6 is a diagram showing an example in which a roller member different from a brush is used as the first removing mechanism.

A roller member 161 shown in FIG. 6 can be obtained by providing, for example, foamed urethane rubber or rubber (solid) set to predetermined hardness in a rotating shaft. It is desirable to add a material indicating electrical conductivity such as carbon to a foamed urethane rubber layer or a rubber layer to give electrical conductivity thereto and, like the brush member shown in FIG. 4B and FIGS. 5A and 5B, charge the roller member 161 to have voltage provided by a power supply 162 having polarity (plus) opposite to the polarity of the unnecessary toner and the foreign matters.

The roller member 161 can also be obtained by using metal for the rotating shaft and a roller structure section and providing coating containing a material, the resistance (the specific resistance) of which is set in a predetermined range, in the roller structure section.

Like the brush 121 and the brush 151, the roller member 161 has a space indicated by "S" between the roller member 161 and the belt surface of the sheet conveying belt 62.

FIGS. 7, 8 9A, 9B, 10, and 11 are diagrams showing various examples of the first and second removing mechanisms for realizing the foreign-matter removing unit, an example of which is shown in FIGS. 4A and 4B.

Figure 7:
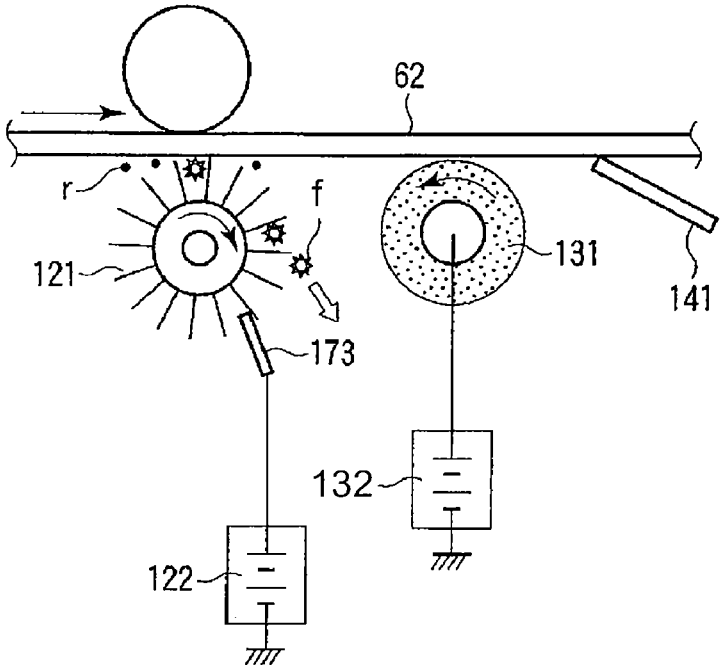
FIG. 7 is an exemplary diagram showing an example of operation and a device for removing an unnecessary toner and foreign matters remaining on a sheet conveying belt as a result of the operation of the transfer device shown in FIG. 2 according to an embodiment.

In the foreign-matter removing unit shown in FIG. 7, a component configured to apply voltage to the first removing mechanism (the brush roller 121) is a brush cleaner 173 made of a conductive member such as a metal plate or a mesh metal.

The ability of the brush roller 121 for capturing the toner and the foreign matters gradually falls as the number of times of image formation increases. Therefore, if the plus voltage provided by the power supply 122 is supplied to, the brush cleaner 173, it is possible to separate the toner and the foreign matters captured by the brush roller 121 from the brush roller 121 at higher efficiency compared with the example shown in FIGS. 4A and 4B.

Figure 8:
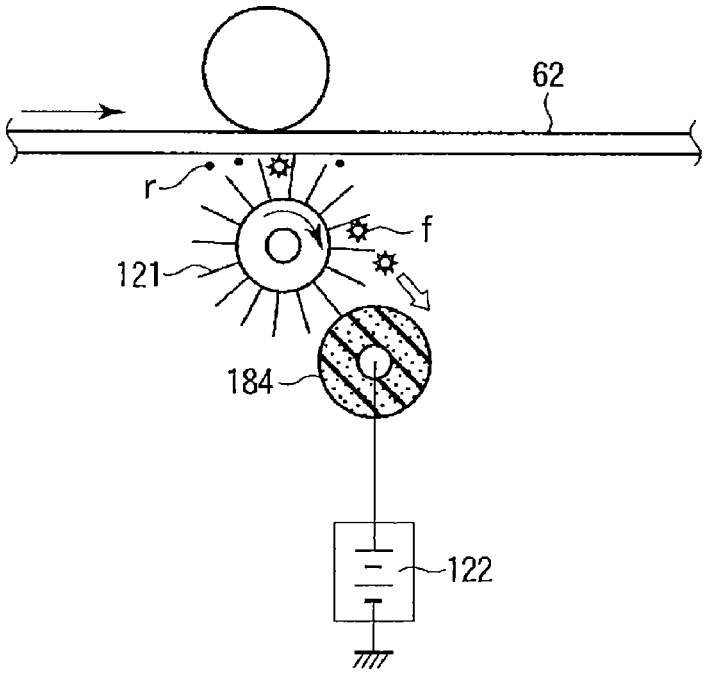
FIG. 8 is an exemplary diagram showing an example of operation and a device for removing an unnecessary toner and foreign matters remaining on a sheet conveying belt as a result of the operation of the transfer device shown in FIG. 2 according to an embodiment.

In the foreign-matter removing unit shown in FIG. 8, the component configured to apply voltage to the first removing mechanism (the brush roller 121) is a brush cleaning roller 184 in which an elastic member exhibiting electrical conductivity is formed in a roller shape.

In the configuration shown in FIG. 8, compared with the configuration in which the brush cleaner 173 shown in FIG. 7 is used, further improvement of the ability for separating the toner and the foreign matters captured by the brush roller 121 from the brush roller 121 can be expected, because, for example, the roller member exhibiting electrical conductivity similar to the roller shown in FIG. 6 is used in the brush cleaning roller 184 and the plus voltage provided by the power supply 122 is supplied to the brush roller 121.

As explained later with reference to FIG. 12, the foreign-matter removing unit shown in FIGS. 9A and 9B includes, as the second removing mechanism, fiber containing, for example, rayon as a material, the resistance (the specific resistance) of which is set in a predetermined range.

Figure 9A:
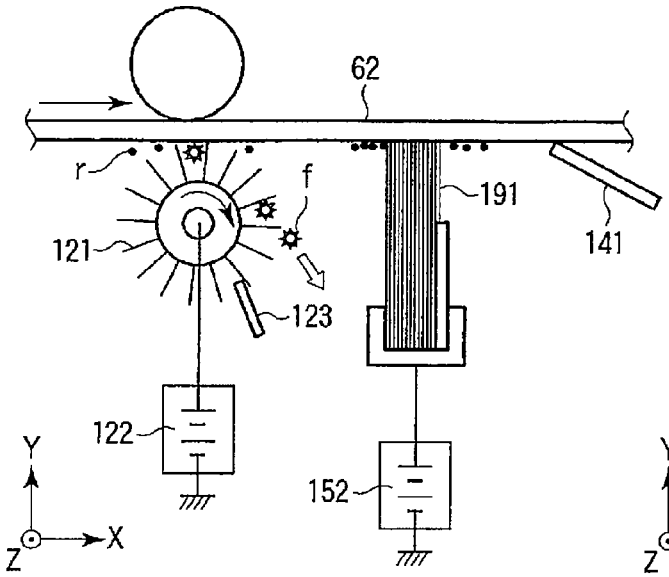
FIG. 9A is an exemplary diagram showing an example of operation and a device for removing an unnecessary toner and foreign matters remaining on a sheet conveying belt as a result of the operation of the transfer device shown in FIG. 2 according to an embodiment.
Figure 9B:
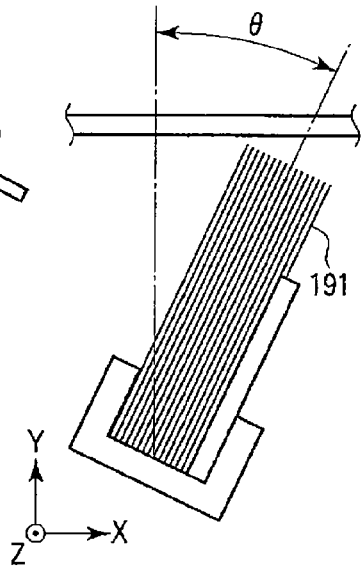
FIG. 9B is an exemplary diagram showing an example of characteristics of the operation and the device for removing the unnecessary toner and the foreign matters shown in FIG. 9A according to an embodiment.

The brush 191 shown in FIGS. 9A and 9B is configured substantially the same as the brush 151 shown in FIG. 5A. The brush 191 comes into contact with the belt surface of the sheet conveying belt 62 at predetermined pressure. The brush 191 has voltage provided by the power supply 152 having polarity (plus) opposite to the polarity of the unnecessary toner and the foreign matters.

Since the brush 191 does not rotate, it is desirable to thrust the brush 191 in, for example, the longitudinal direction of the photoconductive drum 31, i.e., the front to rear direction of the MFP using a not-shown driving mechanism (e.g., a cam mechanism) and change a position where a specific portion of the brush 191 is opposed to a specific portion of the belt surface of the sheet conveying belt 62. Vibration during reversal of a swinging and moving direction of the brush 191 by the thrusting is useful for separating the toner and the foreign matters captured by the brush 191 from the brush 191. The thrusting improves an ability for capturing the toner and the foreign matters from the sheet conveying belt 62.

It is desirable that the brush 191 is located in non-parallel to the "Y" direction orthogonal to the longitudinal direction of the photoconductive drum 31, i.e., the front to rear direction of the MFP and the direction in which the belt surface of the sheet conveying belt 62 moves, i.e., the direction orthogonal to the belt surface. It is desirable that, as shown in FIG. 9B, a direction in which the brush 191 tilts with respect to the direction orthogonal to the belt surface is the direction in which the belt surface of the sheet conveying belt 62 moves. An amount of the tilt (an angle θ) is desirably, for example, 20° to 30°.

Figure 10:
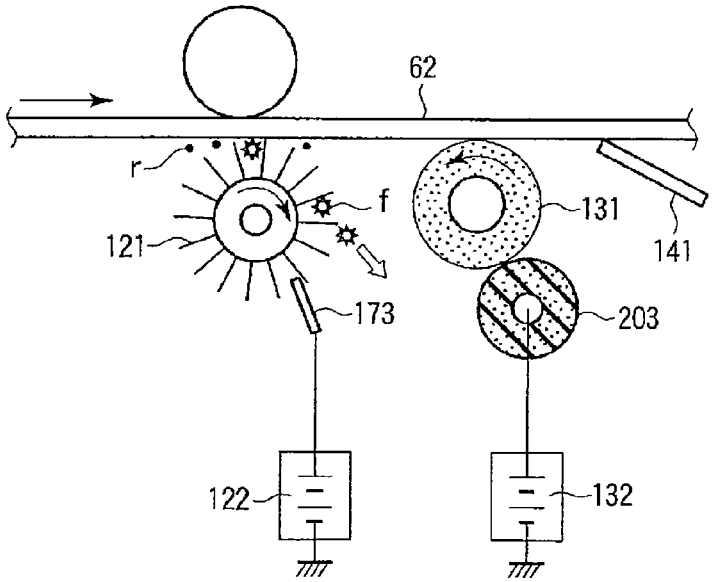
FIG. 10 is an exemplary diagram showing an example of operation and a device for removing an unnecessary toner and foreign matters remaining on a sheet conveying belt as a result of the operation of the transfer device shown in FIG. 2 according to an embodiment.

In the foreign-matter removing unit shown in FIG. 10, the component configured to apply voltage to the second removing mechanism (the brush roller 131) is a brush cleaning roller 203 in which an elastic member exhibiting electrical conductivity is formed in a roller shape.

In the configuration shown in FIG. 10, compared with the configuration in which the brush roller 131 shown in FIG. 7 or FIGS. 4A and 4B is charged to have voltage provided by the power supply 132 having polarity (plus) opposite to the polarity of the unnecessary toner and the foreign matters, the ability for separating the toner and the foreign matters captured by the brush roller 131 from the brush roller 131 can be improved because, for example, the roller member exhibiting electrical conductivity similar to the roller shown in FIG. 8 is used in the brush cleaning roller 203 and the plus voltage provided by the power supply 132 is supplied to the brush roller 131.

The ability of the brush roller 131 for capturing the toner and the foreign matters gradually falls as the number of times of image formation increases. Therefore, if the plus voltage provided by the power supply 132 is supplied to the brush cleaner 203, it is possible to separate the toner and the foreign matters captured by the brush roller 131 from the brush roller 131 at higher efficiency compared with the example shown in FIGS. 4A and 4B.

Figure 11:
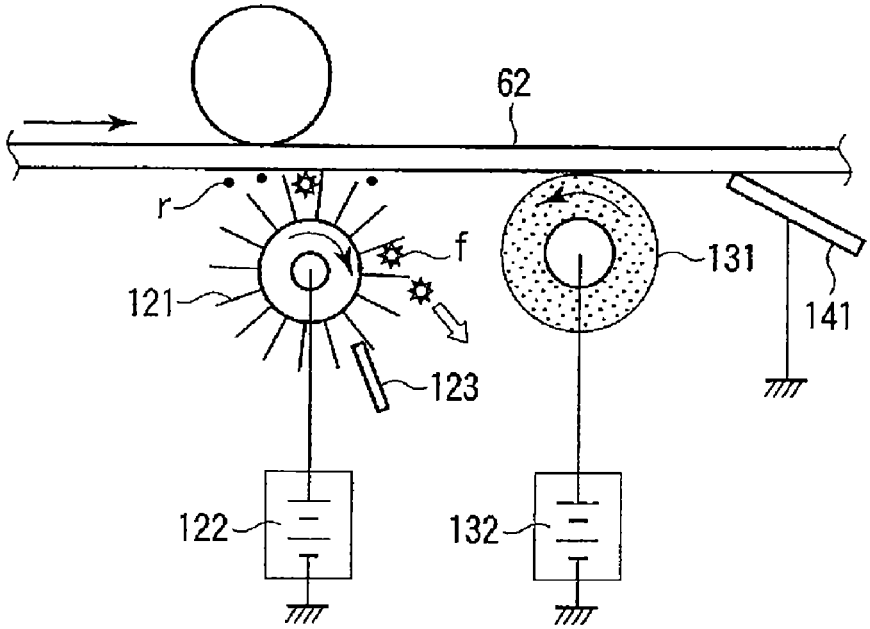
FIG. 11 is an exemplary diagram showing an example of operation and a device for removing an unnecessary toner and foreign matters remaining on a sheet conveying belt as a result of the operation of the transfer device shown in FIG. 2 according to an embodiment.

In the foreign-matter removing unit shown in FIG. 11, the third removing mechanism (the scraper (the blade) 141) is grounded. Therefore, it can also be expected that an inverted toner generated at a predetermined probability (the toner having charging polarity inverted to plus because the toner is integrated with the foreign matters or rubs against the sheet material or a surface coating agent on the belt surface of the sheet conveying belt 62) is captured. It is also useful to ground the third removing mechanism (the scraper (the blade) 141) (setting the potential of the third removing mechanism to 0V) in terms of reducing electric power.

Figure 12:
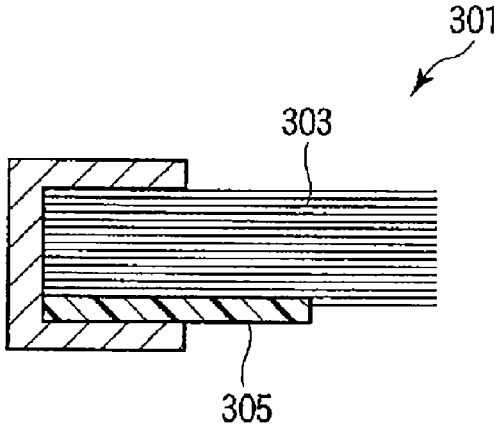
FIG. 12 is an exemplary diagram showing an example of a characteristic of a brush member applied to the configuration for removing the unnecessary toner and the foreign matters shown in FIG. 7 and FIGS. 9A and 9B according to an embodiment.

FIG. 12 is a diagram for explaining the configuration of a brush used in the brush-like foreign-matter removing mechanism shown in FIGS. 4A, 4B, 5A, 5B, 9A, and 9B. In FIG. 12, the brush 121 (shown in FIGS. 4A and 4B), the brush 151 (shown in FIGS. 5A and 5B), and the brush 191 (shown in FIGS. 9A and 9B) are denoted by reference numeral 301.

The brush 301 includes a brush member 303 arrayed at density of 86 bundles/inch by binding, for example 100 pieces of fiber of rayon containing carbon at specific resistance of $10^6$ Ω·cm and thickness of 6 D (denier) as one bundle.

The brush member 303 of the brush 301 is prevented from falling to the downstream side in the moving direction of the belt surface of the sheet conveying belt 62 by a backing seal material 305 of a polyester sheet having thickness of, for example, 0.1 mm. The backing seal material 305 is desirably set in a state in which the bristle end (the tip) of the brush member 303 projects about 1 mm (a state in which the backing seal material 305 is shorter than the brush member 303).

The same effect is obtained when the brush member 303 of the brush 301 is changed to a conductive member (a material) such as a rubber sheet or a sponge material.

Figure 13A:
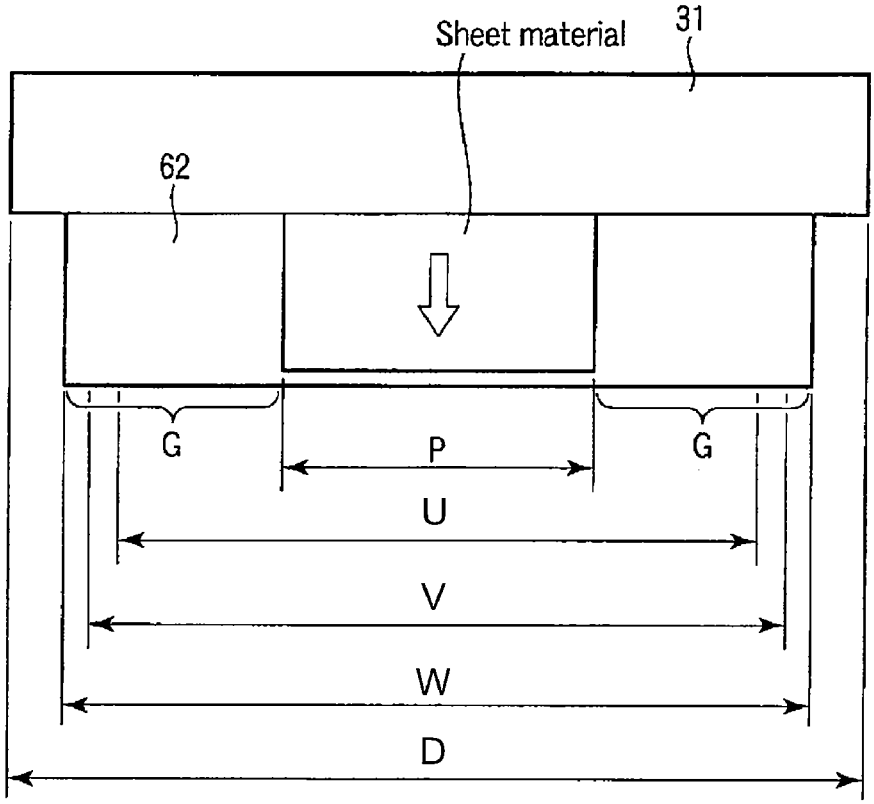
FIGS. 13A and 13B are exemplary diagrams, each showing an example of operation and a device for removing an unnecessary toner and foreign matters remaining in the width direction of a sheet conveying belt (the front to rear direction of the MFP) as a result of the operation of the transfer device shown in FIG. 2 according to an embodiment.
Figure 13B:
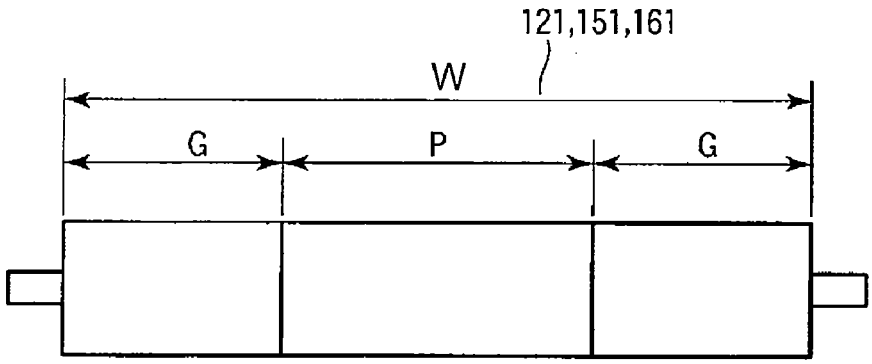

FIGS. 13A and 13B indicates that the foreign-matter removing unit configured to remove the unnecessary toner and the foreign matter has at least two removing levels in the front to rear direction of the MFP 101, i.e., the direction orthogonal to the direction in which the sheet conveying belt 62 moves while conveying the sheet material.

In FIGS. 13A and 13B, the following lengths are schematically shown: length "D" in the front to rear direction of the photoconductive drum 31, the width of the sheet conveying belt 62, i.e., length "W" in the direction orthogonal to the direction in which the sheet conveying belt 62 moves while conveying the sheet material, and the width of the sheet material (different depending on a size), i.e., length of the sheet material (the width of the sheet material) "P" in the direction orthogonal to the direction in which the sheet conveying belt 62 moves when the sheet material is conveyed by the sheet conveying belt 62. A relation among the lengths is "D>W>P". Width in which an image to be output is formed is represented as "U". Cleaning width in which the foreign matter removing unit 111 should remove the toner and the foreign matters from the sheet conveying belt 62 is represented as "V". FIGS. 13A and 13B show an example in which the sheet material moves (while being conveyed by the sheet conveying belt 62) in a state in which, irrespectively of a size of the sheet material, the center in the width direction of the sheet material generally coincides with the center in the width (depth) direction of the sheet conveying belt 62 and the photoconductive drum 31.

The size, in particular, maximum width of an output image formed by the MFP 101 depends on the width of the photoconductive drum 31. Minimum width of the output image depends on the width of the sheet material (a size of the sheet material).

Specifically, if image formation is continued under a condition in which "W/2>P" and an amount of the toner and the foreign matters adhering to the sheet conveying belt 62 increases, the toner and the foreign matters are likely to remain on the sheet conveying belt 62 in an area of "[V-W]" indicated by "G", i.e., an area "2G" in which the cleaning width "V" is large compared with the width of the sheet material "P".

Therefore, it is desirable to divide the foreign-matter removing unit 111 into two stages concerning an area where "G" indicating "W/2>P" defining that "P" is specified as minimum width of the sheet material on which image formation is possible takes a maximum value. In other words, concerning the two areas "G" on both sides of "P", it is desirable to improve the ability of the first removing mechanism for removing the toner and the foreign matters, for example, set the resistance of coating of conductive fiber or roller used in a brush "low" compared with the resistance of coating of the fiber or the roller of the brush applied to removal of the toner and the foreign matters in the center, i.e., the area "P" or set the density of the fiber or a bundle of fiber forming the brush "high".

As explained above, in the cleaning apparatus configured to remove the residual toner and the foreign matters such as paper scum from the belt surface of the sheet conveying belt (the image bearing member), the first removing mechanism not in contact with the belt surface, the second removing mechanism set in contact with the belt surface, and the third removing mechanisms configured to scrape off the residual toner and the foreign matters while applying predetermined pressure to the belt surface are arranged from the upstream side in the direction in which the belt surface moves. Therefore, stable cleanability can be secured.

The first foreign-matter removing mechanism removes, not in contact with the belt surface, dust entering the apparatus via a sheet, fiber of the sheet, and the foreign matters formed by the dust, fiber, and the like integrated with the toner. Therefore, the second and third removing mechanisms are effective for small objects to be removed having a diameter of about 6 μm to 10 μm mainly containing the toner.

Since the first removing mechanism not in contact with the belt surface and the second removing mechanism set in contact with the belt surface are located at the pre-stage of the third removing mechanism, cleanability can be secured.

Clogging of the first foreign-matter removing mechanism is suppressed by an auxiliary unit such as a scraper (a metal plate or a metal cylinder).

Since the auxiliary unit has voltage having polarity opposite to the polarity of the toner, a foreign-matter removing ability of the auxiliary unit falls little.

If the auxiliary unit is grounded, a high capturing ability can be also expected for an inverted toner having inverted charging polarity.

The toner and the foreign maters moving from the belt surface can be collected in a collecting unit because the toner and the foreign matters free-fall. Therefore, a mechanism for collection is unnecessary.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A cleaning mechanism comprising:

a first scraping-off and agitating member, located to be opposed to a belt surface and located to be a predetermined space apart from the belt surface, configured to scrape off, to agitate, or to capture a visualizing material, and fiber or powder different from the visualizing material, that are present on the belt surface;

a second scraping-off and agitating member, located in contact with the belt surface, configured to scrape off, to agitate, or to capture the visualizing material and the fiber or the powder different from the visualizing material; and a scraping-off member, located in contact with the belt surface, configured to scrape off the visualizing material and the fiber or powder different from the visualizing material; and an auxiliary scraping-off member, having a voltage polarity that is opposite to a voltage polarity of the visualizing material, configured to scrape off the visualizing material and the fiber or the powder different from the visualizing material that are captured by the first scraping-off and agitating member.

2. The mechanism of claim 1, wherein the first scraping-off and agitating member can provide two or more scraping-off and agitating levels in a width direction of the belt surface.

3. The mechanism of claim 1, wherein the second scraping-off and agitating member can provide two or more scraping-off and agitating levels in a width direction of the belt surface.

4. The mechanism of claim 1, wherein the scraping-off member can provide two or more scraping-off and agitating levels in a width direction of the belt surface.

5. The mechanism of claim 1, wherein the first scraping-off and agitating member can provide two or more scraping-off and agitating levels in a width direction of the belt surface.

6. A cleaning mechanism comprising:

a first scraping-off and agitating member, located to be opposed to a belt surface and located to be a predetermined space apart from the belt surface, and having a voltage polarity that is opposite to a voltage polarity of the visualizing material, configured to scrape off, to agitate, or to capture a visualizing material, and fiber or powder different from the visualizing material, that are present on the belt surface;

a second scraping-off and agitating member, located in contact with the belt surface, configured to scrape off, to agitate, or to capture the visualizing material and the fiber or the powder different from the visualizing material;

a scraping-off member, located in contact with the belt surface, configured to scrape off the visualizing material and the fiber or powder different from the visualizing material; and an auxiliary scraping-off member configured to scrape off the visualizing material and the fiber or the powder different from the visualizing material captured by the first scraping-off and agitating member.

7. The mechanism of claim 6, wherein the second scraping-off and agitating member can provide two or more scraping-off and agitating levels in a width direction of the belt surface.

8. The mechanism of claim 6, wherein the scraping-off member can provide two or more scraping-off and agitating levels in a width direction of the belt surface.

9. The mechanism of claim 6, wherein the first scraping-off and agitating member can provide two or more scraping-off and agitating levels in a width direction of the belt surface.

10. A cleaning mechanism, comprising:

a first scraping-off and agitating member, located to be opposed to a belt surface and located to be a predetermined space apart from the belt surface, configured to scrape off, to agitate, or to capture a visualizing material, and fiber or powder different from the visualizing material, that are present on the belt surface;

a second scraping-off and agitating member, located in contact with the belt surface, configured to scrape off, to agitate, or to capture the visualizing material and the fiber or the powder different from the visualizing material;

a scraping-off member, located in contact with the belt surface, configured to scrape off the visualizing material and the fiber or powder different from the visualizing material, and wherein the scraping-off member is grounded.

11. The mechanism of claim 10, further comprising an auxiliary scraping-off member configured to scrape off the visualizing material and the fiber or the powder different from the visualizing material captured by the first scraping-off and agitating member.

12. The mechanism of claim 11, wherein the auxiliary scraping-off member has a voltage polarity that is opposite to a voltage polarity of the visualizing material.

13. The mechanism of claim 10, wherein the second scraping-off and agitating member can provide two or more scraping-off and agitating levels in a width direction of the belt surface.

14. The mechanism of claim 10, wherein the scraping-off member can provide two or more scraping-off and agitating levels in a width direction of the belt surface.

15. A method for cleaning comprising:

scraping off, agitating, or capturing, in non-contact with a belt surface, a visualizing material, and fiber or powder different from the visualizing material, that are present on the belt surface;

coming into contact with the belt surface and scraping off, agitating, or capturing the visualizing material and the fiber or the powder different from the visualizing material;

being located in contact with the belt surface at predetermined pressure and scraping off the visualizing material and the fiber or powder different from the visualizing material; and further scraping off, with an auxiliary scraping-off member having a voltage polarity that is opposite to a voltage polarity of the visualizing material, the visualizing material and the fiber or the powder different from the visualizing material captured.

16. An image forming apparatus comprising:

a visible image bearing belt having a belt surface that moves in a predetermined direction and configured to bear a visible image formed of a visualizing material on the belt surface; and a belt surface cleaner including a first scraping-off and agitating member not in contact with the belt surface that scrapes off, agitates, or captures a visualizing material, and fiber or powder different from the visualizing material, that are present on the belt surface, a second scraping-off and agitating member set in contact with the belt surface that scrapes off, agitates, or captures the visualizing material and the fiber or the powder different from the visualizing material, and a scraping-off member set in contact with the belt surface that scrapes off the visualizing material and the fiber or powder different from the visualizing material located in order along a direction in which the belt surface of the visible image bearing belt moves, and an auxiliary scraping-off member, having a voltage polarity that is opposite to a voltage polarity of the visualizing material, configured to scrape off the visualizing material and the fiber or the powder different from the visualizing material captured by the first scraping-off and agitating member.

* * * * *